US009303347B2

(12) United States Patent
Hull

(10) Patent No.: US 9,303,347 B2
(45) Date of Patent: Apr. 5, 2016

(54) CONTROLLING CURRENT DRAW IN A LAUNDRY TREATING APPLIANCE

(71) Applicant: Whirlpool Corporation, Benton Harbor, MI (US)

(72) Inventor: James B. Hull, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 299 days.

(21) Appl. No.: 13/928,433

(22) Filed: Jun. 27, 2013

(65) Prior Publication Data

US 2015/0000046 A1 Jan. 1, 2015

(51) Int. Cl.

| | |
|---|---|
| ***D06F 39/00*** | (2006.01) |
| ***D06F 21/00*** | (2006.01) |
| ***D06F 33/02*** | (2006.01) |
| *D06F 39/04* | (2006.01) |
| *D06F 35/00* | (2006.01) |
| *D06F 37/30* | (2006.01) |

(52) U.S. Cl.

CPC ..... *D06F 21/00* (2013.01); *D06F 33/02* (2013.01); *D06F 35/006* (2013.01); *D06F 37/304* (2013.01); *D06F 39/04* (2013.01); *D06F 2202/12* (2013.01); *D06F 2204/04* (2013.01); *D06F 2204/065* (2013.01)

(58) Field of Classification Search

CPC . D06F 33/02; D06F 37/203; D06F 2204/065; D06F 2202/10; D06F 39/003

USPC ..... 8/137, 158, 159; 68/12.01, 12.02, 68/12.16, 139, 12.23, 19, 24, 12.12, 12.19, 68/13 R; 318/729, 432, 434

See application file for complete search history.

(56) References Cited

U.S. PATENT DOCUMENTS

| | | | | |
|---|---|---|---|---|
| 4,856,301 | A * | 8/1989 | Broadbent | 68/12.23 |
| 5,647,232 | A * | 7/1997 | Boldt et al. | 68/12.02 |
| 7,017,377 | B2 | 3/2006 | Hosoito et al. | |
| 7,049,785 | B2 | 5/2006 | Han | |
| 7,299,664 | B2 | 11/2007 | Chang et al. | |
| 8,176,798 | B2 | 5/2012 | Ashrafzadeh et al. | |
| 2011/0016738 | A1* | 1/2011 | Ashrafzadeh et al. | 34/108 |
| 2011/0061176 | A1* | 3/2011 | Kappler et al. | 8/137 |

FOREIGN PATENT DOCUMENTS

| | | | | |
|---|---|---|---|---|
| GB | 2322141 | A * | 8/1998 | D06F 35/00 |

* cited by examiner

*Primary Examiner* — Michael Barr
*Assistant Examiner* — Thomas Bucci

(57) ABSTRACT

A method of operating a laundry treating appliance having a rotatable container at least partially defining a treating chamber, a motor for rotating the treating chamber, and an electric heater for heating liquid supplied to or in the treating chamber by simultaneously operating the electric motor to effect the rotation of the treating chamber and operating an electric heating element to heat liquid.

16 Claims, 3 Drawing Sheets

CONTROLLING CURRENT DRAW IN A LAUNDRY TREATING APPLIANCE

BACKGROUND

Applicable standards may limit the electric current drawn by laundry treating appliances, such as a clothes washing machine, to a preselected threshold value, such as may be established by Underwriters Laboratories or the National Electrical Code. For example, the washing machine may be coupled into a 120 VAC circuit by a 15 amp power cord matching the circuit amperage. However, actual current draw may be limited to a lower amperage, e.g. 12 amps, resulting in a lower power output.

Contemporary washing machines include a multitude of electricity consuming components. Two of the greatest current drawing components are the motor and the resistive heater. The simultaneous operation of the motor and heater will typically require current draws in excess of the power cord threshold value, especially for 120V, 15 amp circuits commonly found in the United States, which can lead to a tripping of corresponding circuit breaker for the circuit. Even in countries with greater power cord threshold values, in order to maximize the heating rate to minimize the cycle time, there is still a tendency for the motor and heater to be selected such that their simultaneous operation exceeds the power cord threshold value.

BRIEF DESCRIPTION OF THE INVENTION

Liquid in a rotatable drum treating chamber of a laundry treating appliance is heated during a liquid heating phase by supplying electricity to a resistive heating element. The drum is accelerated to a first rotational speed at or above a preset tumbling speed, followed by decay from the first rotational speed to a second rotational speed below the preset tumbling speed by the application to a drum rotating motor of a torque insufficient to maintain the drum at the predetermined tumbling speed. The applied torque is set such that the sum of the current drawn by the resistive heating element during the liquid heating phase and the current drawn by the motor during the decay phase does not exceed a predetermined current limit.

DESCRIPTION OF AN EMBODIMENT OF THE INVENTION

Figure 1:
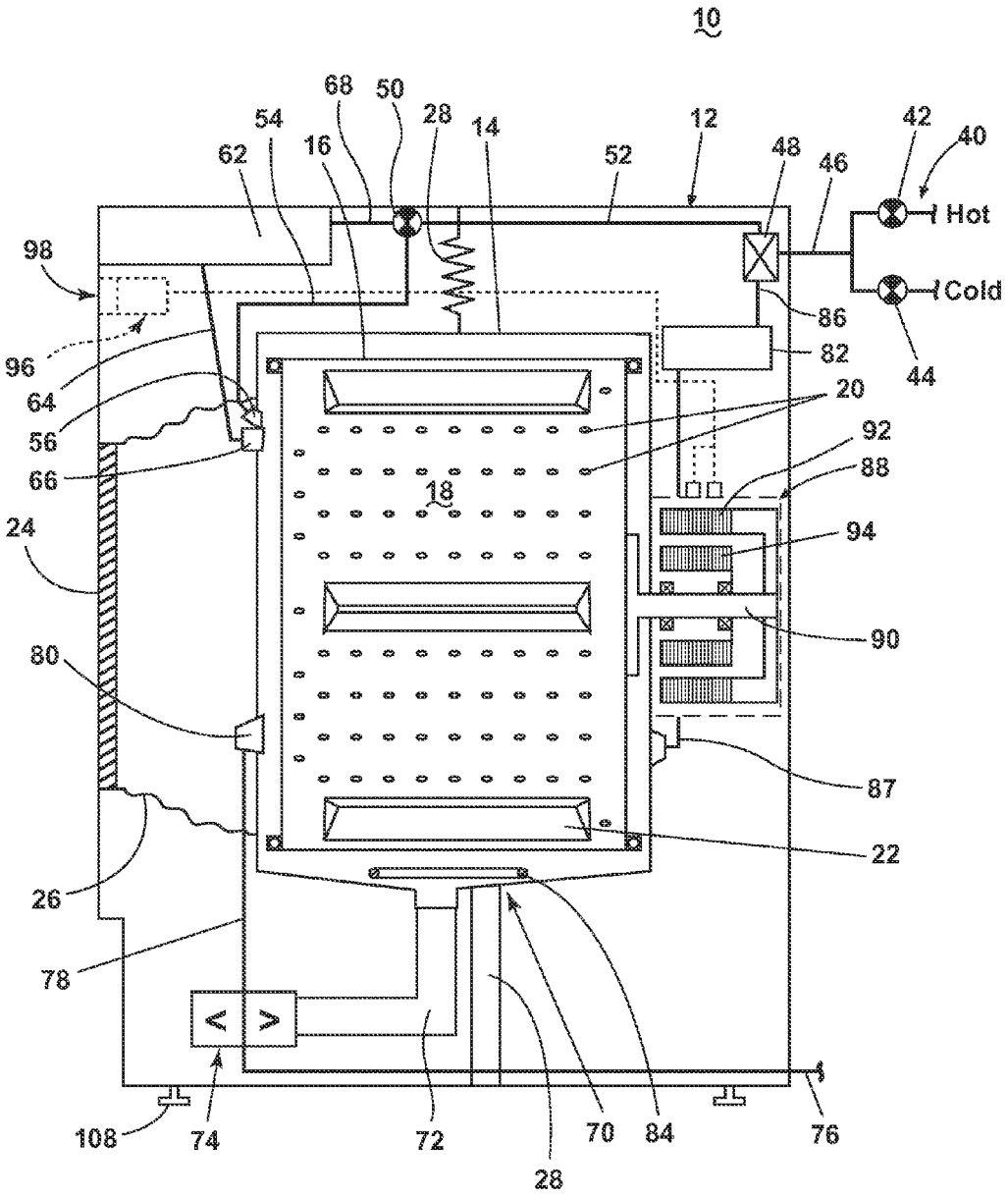
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of lifters 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system. The washing machine 10 may also include feet 108 extending from the cabinet 12 and supporting the cabinet 12 on a floor.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single use and bulk dispenser.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a resistive sump heating element 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow-through steam generator or a tank-type steam generator. Alternatively, the sump heating element 84 may be used to generate steam in place of or in addition to the steam generator 82. In addition to, or instead of, generating steam, the steam generator 82 and/or sump heating element 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 14 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The motor 88 may include a known motor torque sensor (not shown) to monitor the torque developed by the motor 88 during selected cycles of operation. Contemporary electric motors have an integrated motor controller that provides a torque output, resulting in a built-in motor torque sensor. Motor torque is a function of the inertia of a rotating drum and laundry. There are known methods for determining the load inertia, and thus the load mass, based on motor torque. It should be understood that the details of the relationship between torque sensor output, laundry load inertia, and laundry load amount are not germane to the embodiments of the invention, and will not be described further herein except as may be necessary for a complete understanding of the invention.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller, which, as previously mentioned, may provide a torque value output, which may be received by the machine controller. Many known types of controllers may be used for the controller 96. The specific type of controller is not germane to the invention. It is contemplated that the controller is a microprocessor-based controller that implements control software and sends/receives one or more electrical signals to/from each of the various working components to affect the control software. As an example, proportional control (P), proportional integral control (PI), and proportional derivative control (PD), or a combination thereof, a proportional integral derivative control (PID control), may be used to control the various components.

Figure 2:
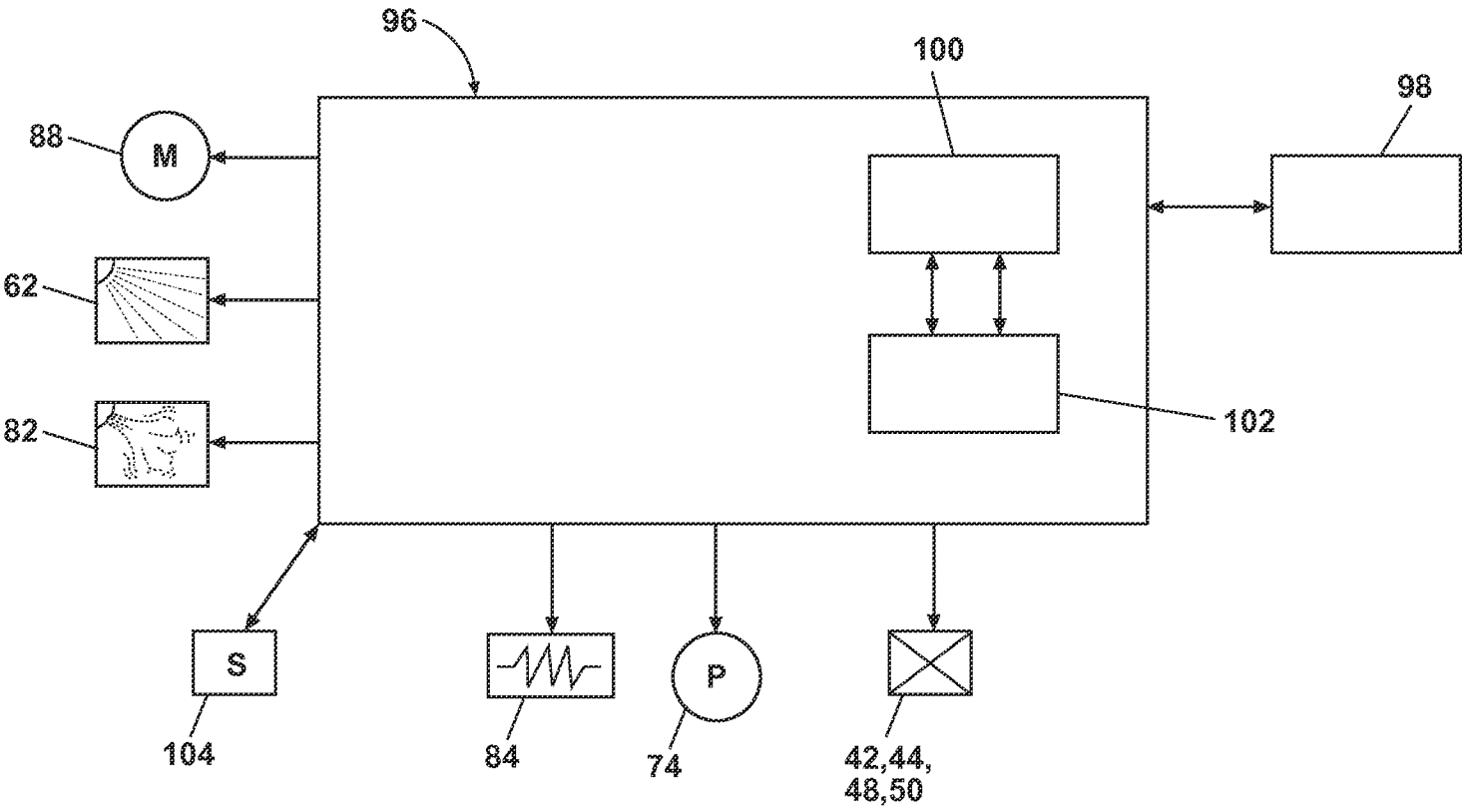
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heating element 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

During a cycle of treatment, laundry items may experience movement within the laundry treating chamber from rotation of the drum 16. The desired movement of the laundry may be categorized into one or more of several categories of movement known in the art. Non-limiting examples of movement categories include tumbling, rolling, sliding, and satellizing. These are terms of art that may be used to describe the motion of some or all of the items forming the laundry load. However, not all of the items forming the laundry load need exhibit the motion for the laundry load to be described accordingly.

A brief description of each motion will be useful in understanding the term. Tumbling, also referred to as lift and drop, is a condition in which the laundry may be lifted by the rotating drum 16 from a lower position, generally near or at the bottom of the drum 16, to a raised position, above the lower position, where the laundry is no longer being lifted by the drum 16 and falls within the drum 16, generally toward the bottom of the drum 16. The rotation of the laundry articles with the drum 16 may be facilitated by the lifters 22. During tumbling, the individual laundry articles may move relative to one another such that the articles may rub against each other and may fall onto each other as they fall to the lower position of the drum 16. This may generate article-to-article friction, which may provide mechanical cleaning action to the laundry articles.

Rolling, also referred to as balling, is a condition in which the laundry may not be lifted by the drum 16 as the drum 16 rotates, such as occurs during tumbling, but rolls or rotates while part of the laundry may still be in contact with the interior surface of the drum 16 and/or the lifter 22. In this condition, a frictional force may be present that causes the laundry to move in a rolling or folding manner with little or no motion above its horizontal position in the drum 16. Rolling may occur with laundry items that are too large or heavy to be lifted by the drum 16 or when a laundry item becomes entangled with another item.

Sliding is another condition in which the laundry may not be lifted by the drum 16 as the drum rotates, such as occurs during tumbling, but may remain at or near the bottom of the drum 16. Sliding differs from rolling in that the laundry does not move in a rolling or folding manner, rather, it slides off the inner surface of the drum 16 as the drum 16 rotates, generally exposing the same face of the laundry to the liquid in the washing machine 10.

Satellizing is a condition in which the laundry may be held by centrifugal force against the inner surface of the drum 16 as the drum 16 rotates. During satellizing, the motor 88 may rotate the drum 16 at rotational speeds, i.e. a spin speed, wherein the laundry items creating the laundry load in the treating chamber 18 are held against the inner surface of the drum 16 and rotate with the drum 16 without falling. This is known as the laundry being satellized or plastered against the drum 16. Typically, the force applied to the laundry items at the satellizing speeds is greater than or about equal to 1G. For a horizontal axis washing machine 10, the drum 16 may rotate about an axis that may be inclined relative to the horizontal, in which case the term "1G" refers to the vertical component of the centrifugal force vector, and the total magnitude along the centrifugal force vector would therefore be greater than 1G.

Each movement category may have one or more subcategories based on the corresponding rotational speed of the drum 16 and/or the amount of mechanical energy imparted to the laundry. Each movement category and/or subcategory may correspond to a cleaning mode that may be provided to the laundry during a cycle of operation.

In a traditional tumbling operation, the motor and heater are not simultaneously operated, especially for an appliance with a 15 A plug supplied by a 120V, 15 A circuit, because of the likelihood that the combined current draw for the motor and heater may trip the breaker for the circuit. Instead, the motor and heater are operated one at a time, which may sometimes be an alternating operation. The "one at a time" operation results in a longer overall cycle time, which is not desired.

Further in a traditional tumbling operation, the motor is operated to rotate the drum at a constant or steady-state speed, which is typically predetermined to provide the ideal tumbling of the laundry for the particular phase.

The described embodiment of the invention provides for the simultaneous operation of the motor and the heater, which may yield a reduced overall cycle time, while sacrificing the optimal tumbling achieved with the ideal steady-state speed. The described embodiment of the invention may further minimize the effects of not having an optimal tumbling by taking advantage of the acceptability under the governing electrical codes of having a transient current threshold, such as occurs during motor start-up, which may be greater than the preselected steady-state current limit. Thus, it is permissible to temporarily exceed the steady-state current limit.

Specifically, the heater and motor may be simultaneously operated, with the heater being turned on while the motor is accelerated during an acceleration phase to a maximum initial speed that is limited by the transient current threshold. After the acceleration phase, the motor may be rotated at a decelerating rate to define a decay phase. The decelerating rate may be accomplished by applying a torque to the motor such that the combined current draw of the motor and heater does not exceed the steady-state limit for the governing electrical code.

The maximum speed reached during the acceleration phase may typically exceed the desired steady-state speed and may often be great enough to satellize at least some, if not all, laundry items. The speed during the decay phase typically may initially exceed the desired steady-state speed for idealized tumbling, but may eventually fall below the steady-state speed for idealized tumbling. The minimum achievable speed may be based on the ability of the controller 96 to operate the motor 88 within preselected motor specifications, such as rotational speed stability, efficiency, heat generation, and the like. The minimum speed may be as low as 20 rpm, corresponding to 0.1G. At some point the rotational speed during the decay phase will slow enough that the tumbling benefit or rate of benefit is sufficiently reduced that the decay phase will be terminated.

It is typical in a tumbling phase to alternate the direction of rotation of the drum to prevent the laundry from tangling or twisting. Advantageously, the termination of the decay phase can be the trigger for reversing the direction of rotation by starting another sequence, in the opposite direction, of the acceleration phase followed by the decay phase. The alternating directions may be repeated as many times as needed.

Figure 3:
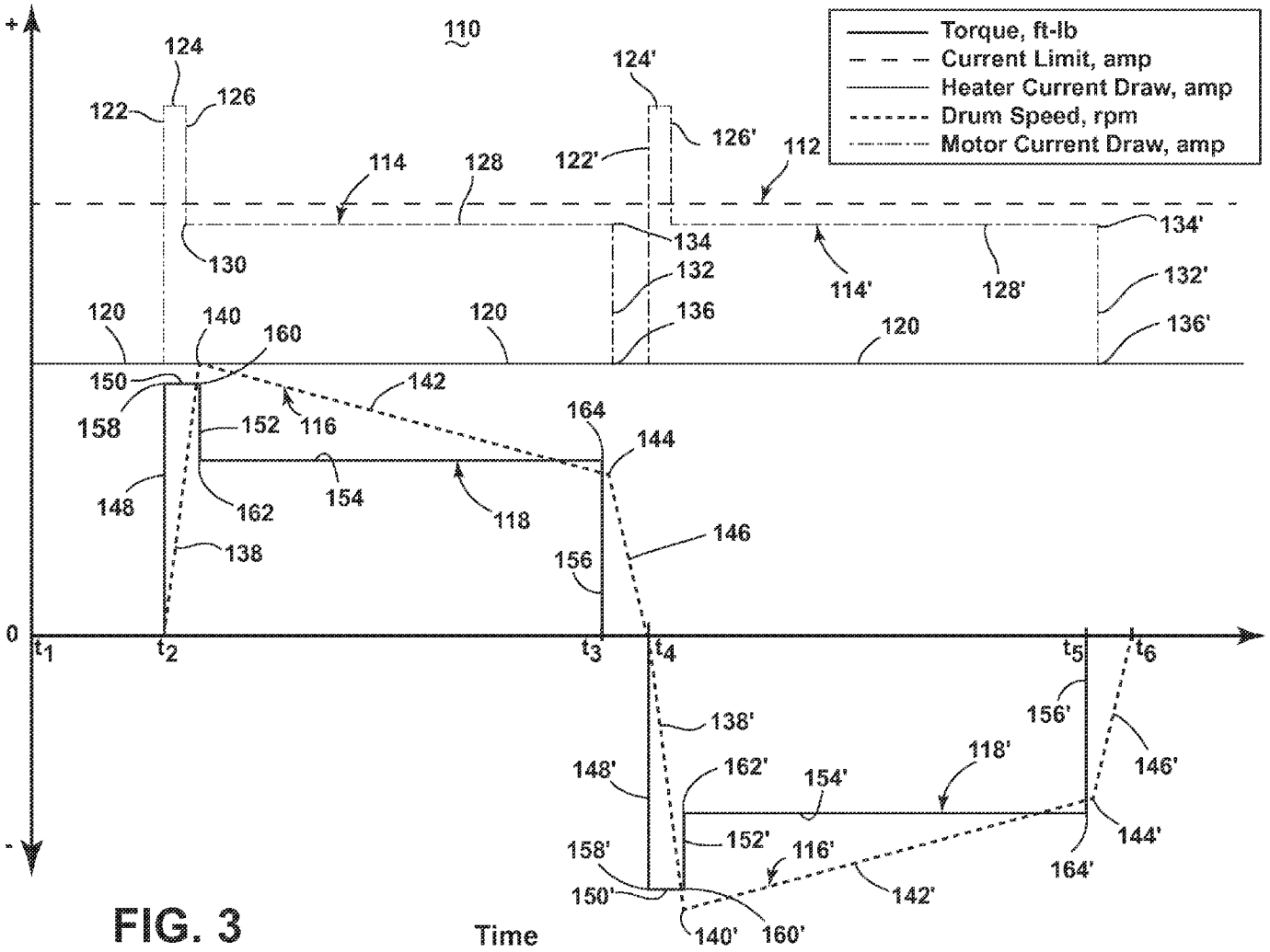
FIG. 3 is a graphical representation of an exemplary washing machine current draw, torque, and drum rotational speed reflecting the control of the washing machine during a portion of a treating cycle according to the first embodiment of the invention.

Referring now to FIG. 3, a correlation between a washing machine motor current draw 114, drum speed 116, and motor torque 118 is graphically illustrated over a selected time interval by a first set of curves associated with an exemplary embodiment of the invention. FIG. 3 illustrates a total current draw as consisting of a continuous heating element current 120, and a drum motor current 114 extending from time $t_2$ to time $t_3$. Initially, between the times $t_1$ and $t_2$ the drum motor 88 may draw no current, and the heating element 84 may draw the continuous current 120, which may be lower than a preselected current limit 112 established pursuant to authorities such as Underwriters Laboratories or the National Electrical Code.

The current limit 112 may be based upon an amperage rating for a power cord for the washing machine or other electric powered appliance. For example, a power cord may have a 15 amp rating, which may match a 15 amp circuit on which the washing machine is powered. The current limit 112 may be set at an amperage less than the 15 amp power cord rating, which may be a percentage of the power cord amperage rating. Thus, for example, the current limit 112 may be set at a value equal to 80% of the power cord amperage rating, i.e. 15 amps×0.80=12 amps. Consequently, electric current drawn concurrently by both the washing machine drum motor 88 and the sump heating element 84 may be limited to 12 amps.

The heating element 84 may remain on during an entire treating cycle whether wash liquid is heated or not, so that the continuous current 120 drawn by the heating element 84 may extend without regard for a duty cycle. Alternatively, the heating element 84 may remain on only during a duty cycle, such as during a wash cycle or a rinse cycle, and only when the duty cycle requires that wash liquid and/or rinse liquid are to be heated, so that the continuous current 120 may be drawn only during selected time intervals or duty cycles. If no current may be delivered to the drum motor 88 during the time period $t_1$-$t_2$, no torque may be generated by the drum motor 88, and the drum motor 88 and drum 16 may not rotate.

In either case, if a wash cycle or rinse cycle may include actuation of the heating element 84, the combination of drum motor and heating element use may result in a total current draw greater than the 12 amp current limit. Thus, operation of the drum motor 88 and heating element 84 must be coordinated to maintain total current draw below the 12 amp current limit.

FIG. 3 also illustrates a second set of curves depicting current draw, drum speed 116' and motor torque 118' for the same washing machine 10 beginning at a time $t_4$ and ending at a time $t_6$. This graphical illustration is a minor image of the first set of curves 116, 118, and may reflect rotation of the drum 16 beginning at the time $t_4$ and ending at the time $t_6$. During this time interval, the drum 16 may rotate in a direction opposite the drum rotation that is represented by the first set of curves 116, 118. Except for positioning, the drum speed 116' and motor torque 118' curves are identical to the drum speed 116 and motor torque 118 curves. Line segments and points along the drum speed curve 116' and motor torque curve 118' that correspond to line segments and points along the drum speed curve 116 and motor torque curve 118 are designated by the same reference characters bearing a prime symbol (').

With reference to the washing machine motor current draw 114, at the preselected time $t_2$ the drum motor 88 may begin to draw electric current, which may be reflected in a current spike 122 that, for a brief time interval, may exceed the preselected current limit 112, which may be acceptable under the appropriate standards. The current spike 122 may reach a maximum spike value 124, then terminate, and the current may decrease 126 to a uniform current 128 greater than the uniform current 120, which may reflect the current delivered to both the heating element 84 and the drum motor 88. The uniform current 128 may be selected for gradually decreasing rotation of the drum 16 to a rotational speed 144 somewhat below the satellizing speed, and which may be a tumbling speed.

At a preselected time $t_3$, which may correspond to the end of a cycle of treatment, drum rotation speed may decay to the extent that laundry items no longer receive the mechanical benefit of tumbling. Electric current to the drum motor 88 may be terminated 134, e.g. the illustrated instantaneous motor current drop 132, thereby enabling the drum 16 to come to a stop. The drum motor current draw may be repeated as an essentially identical current draw 114', and modulated to urge the drum motor 88 and drum 16 into rotating in a direction opposite the immediately prior direction. The alternating drum acceleration and decay sequence may be repeated as required to complete the cycle of operation.

With reference to the drum motor torque 118, the torque generated by the motor 88 may increase essentially instantaneously 148 with the current spike 122 to a maximum motor torque 150. As the motor current spike 122 may decrease 126, the motor torque may concomitantly decrease 152 to a uniform motor torque 154 correlative with the uniform current 128. As the uniform current 128 drawn by the motor 88 may be terminated 136, the motor torque 154 may decrease 156 from the uniform value 164 to zero at the time $t_3$.

With reference to the drum rotational speed 116, beginning at the time $t_2$, when the current to the motor 88 may increase 122 beyond the current 120 drawn by the heating element 84 alone, the drum 16 may enter the acceleration phase 138 and begin to rotationally accelerate 138 from zero, i.e. a stationary position, to a preselected rotational speed 140. Thus, the acceleration phase 138 may extend to the rotational speed 140.

The rotational speed 140 may be reached at a time subsequent to the time $t_2$ corresponding to the instantaneous decrease 152 in torque to the uniform motor torque 154. Concurrently with the drum 16 reaching the preselected rotational speed 140, the motor current 114 may be maintained at the uniform level 128 for a preselected time $t_3-t_2$. It may be noted that the preselected initial rotational speed 140 may be at least as great as a preset tumbling speed, and may be at least equal to a satellizing speed. Alternatively, the drum 16 may be accelerated to a rotational speed 140 above the satellizing speed.

Subsequent to reaching the preselected initial rotational speed 140 at the end of the acceleration phase 138, the drum 16 may enter the decay phase 142, during which the rotational speed of the drum 16 may decay to a lower speed 144. In effect, the preselected initial rotational speed 140 may be selected as a function of a first centrifugal force, i.e. a centrifugal force sufficient to hold laundry items against the interior surface of the rotating drum 16. Thus, the preselected initial rotational speed 140 may be the satellizing speed. However, subsequent to reaching the preselected initial rotational speed 140, the rotational speed of the drum 16 may decay to a lower speed 144.

The preselected rotational speed 144 may be selected as a function of a second centrifugal force. This centrifugal force may be insufficient to hold laundry items against the interior surface of the rotating drum 16, but sufficient to lift laundry items from a lower position, generally at or near the bottom of the drum 16, to a raised position, above the lower position. The raised position may be the height at which the laundry items may no longer be lifted by the drum 16, and instead fall within the drum 16, generally toward the bottom of the drum 16. This may represent a centrifugal force sufficient to tumble the laundry items. The first centrifugal force may be greater than 0.98G, and the second centrifugal force may be less than 0.52G.

Selecting the motor current 114 so that it does not exceed the electric current limit 112, may result in the motor torque 118 being sufficient to rotate the drum 16, but insufficient to maintain the drum rotational speed at the preselected rotational speed 140. Consequently, although the current 128 drawn by the drum motor 88 may be constant up to the time $t_3$, the drum rotational speed 142 may gradually decay to the value 144 due to the insufficient torque. With the current removed from the drum motor 88, the decay in drum rotation 146 after current removal may be greater than the decay in drum rotation during the decay phase 142

The rotational speed 144 of the drum 16, i.e. the rotational speed at which current to the motor 88 is stopped, may be selected based upon an efficiency of the motor 88. At rotational speeds 142 greater than the rotational speed 144, motor efficiency may be relatively high. Below the rotational speed 144, motor efficiency may be sufficiently low that current to the motor 88 may be stopped.

When the drum 16 has come to a stop at the time $t_4$, current may be drawn by the motor 88 to resume rotation of the drum, but in 16 in an opposite direction, such as by modulating the current. As illustrated in FIG. 3, while the direction of rotation may be reversed, the magnitude and shape of the torque and rotational speed curves beginning at the time $t_4$ may be identical to the magnitude and shape of the torque and rotational speed curves beginning at the time $t_2$. Thus, drum accelerations 138, 138', drum decays 142, 142', and drum final decays 146, 146' may be superposed.

To summarize, the drum motor 88 may be accelerated to a higher rotational speed than desired, which may be a satellizing speed. The rotational speed may then be reduced to a tumbling speed. After tumbling may be started, the motor 88 may be controlled to generate a torque lower than the torque required to maintain a constant speed. In this condition, the rotational speed may be allowed to decay for a selected period of time or to a selected rotational speed. The torque may be selected so that the current draw of the machine after tumbling begins may not exceed, for example, a UL limit.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance comprising a rotatable drum, at least partially defining a treating chamber, a resistive heating element for heating liquid supplied to the treating chamber, and a motor coupled to and rotatably driving the rotatable drum, the method comprising:

a liquid heating phase where liquid in the treating chamber is heated by the resistive heating element by drawing a first current;

a tumbling phase comprising:

a) an acceleration phase, where the drum is accelerated to a first rotational speed, at least as great as a preset tumbling speed; and b) a decay phase, following the acceleration phase, where the drum decelerates from the first rotational speed to a second rotational speed, less than the preset tumbling speed, wherein the motor applies a torque insufficient to maintain the drum at the preset tumbling speed by drawing a second current; and wherein the torque selected during the decay phase is based on the second current drawn such that the resistive heating element maintains the drawing of the first current, and the sum of the first current drawn by the resistive heating element during the liquid heating phase and the second current drawn by the motor during the decay phase does not exceed a predetermined current limit.

2. The method of claim 1 wherein the first current drawn by the resistive heating element is continuous.

3. The method of claim 1 wherein the first current drawn by the resistive heating element is not based on a duty cycle.

4. The method of claim 1 wherein the predetermined current limit is based on an amperage rating for a power cord for the appliance.

5. The method of claim 4 wherein the predetermined current limit is a percentage of the amperage rating.

6. The method of claim 5 wherein the predetermined current limit is 12 amps for a power cord with a 15 amp amperage rating.

7. The method of claim 1 wherein the first rotational speed is at least equal to a satellizing speed.

8. The method of claim 1 wherein the second rotational speed is a preset speed based on the efficiency of the motor.

9. The method of claim 1 further comprising reversing the direction of rotation of the drum after the rotational speed of the drum reaches the second rotational speed during the decay phase.

10. The method of claim 9 further comprising and repeating a) and b) upon the reversing of direction.

11. The method of claim 1 wherein the first rotational speed is set as a function of a first centrifugal force.

12. The method of claim 11 wherein the second rotational speed is set as a function of a second centrifugal force.

13. The method of claim 12 wherein the first centrifugal force is greater than 0.98 G and the second centrifugal force is less than 0.52 G.

14. The method of claim 1 wherein the acceleration phase further comprises accelerating the drum to a first rotational speed by drawing a third current.

15. The method of claim 14 wherein the sum of the first current drawn by the resistive heating element during the liquid heating phase and the third current drawn by the motor during the acceleration phase temporarily exceeds the predetermined current limit.

16. A method of operating a laundry treating appliance comprising a rotatable drum, at least partially defining a treating chamber, a resistive heating element for heating liquid supplied to the treating chamber, and a motor coupled to and rotatably driving the rotatable drum, the method comprising:

a liquid heating phase where liquid in the treating chamber is heated by the resistive heating element by drawing a first current;

a tumbling phase, simultaneous with the liquid heating phase, comprising:

a) an acceleration phase, where the drum is accelerated to a first rotational speed, at least as great as a preset tumbling speed; and b) a decay phase, following the acceleration phase, where the drum decelerates from the first rotational speed to a second rotational speed, less than the preset tumbling speed, wherein the motor applies a torque insufficient to maintain the drum at the preset tumbling speed by drawing a second current; and during the decay phase, decreasing the torque applied by the motor without adjusting the heating by the resistive heating element such that the sum of the first current drawn by the resistive heating element and the second current drawn by the motor does not exceed a predetermined current limit.

* * * * *